US009668551B2

(12) United States Patent
Sanchez-Valenzuela

(10) Patent No.: US 9,668,551 B2
(45) Date of Patent: Jun. 6, 2017

(54) CLASP SYSTEM

(71) Applicant: Jose Antonio Sanchez-Valenzuela, Aylesbury (GB)

(72) Inventor: Jose Antonio Sanchez-Valenzuela, Aylesbury (GB)

( * ) Notice: Subject to any disclaimer, the term of this patent is extended or adjusted under 35 U.S.C. 154(b) by 114 days.

(21) Appl. No.: 14/080,378

(22) Filed: Nov. 14, 2013

(65) Prior Publication Data

US 2014/0130544 A1 May 15, 2014

(30) Foreign Application Priority Data

Nov. 14, 2012 (GB) ..... 1220490.5

(51) Int. Cl.
*A44C 5/20* (2006.01)

(52) U.S. Cl.
CPC ..... *A44C 5/2076* (2013.01); *A44D 2203/00* (2013.01); *Y10T 24/32* (2015.01)

(58) Field of Classification Search
CPC .... A44C 5/2076; Y10T 24/32; A44D 2203/00
USPC ..... 24/303, 587.11; 63/29.2, 900, 3.1
See application file for complete search history.

(56) References Cited

U.S. PATENT DOCUMENTS 4,622,726 A * 11/1986 Nakamura ..... A44C 5/2057 24/303
4,982,581 A * 1/1991 Furuyama ..... A44C 17/0216 24/303
5,367,891 A * 11/1994 Furuyama ..... A44C 5/2057 24/303
5,572,887 A * 11/1996 Geswelli ..... A44C 5/2071 24/303
6,640,398 B2 * 11/2003 Hoffman ..... A44B 5/00 24/303
6,804,865 B2 * 10/2004 Grunberger ..... A41F 1/002 24/303
6,981,391 B2 * 1/2006 Suzuki ..... A44C 5/2076 24/303
7,523,527 B2 * 4/2009 Garber ..... A44C 5/2061 24/303

(Continued)

FOREIGN PATENT DOCUMENTS

DE 29923483 U 11/2000
JP H10179219 A 7/1998

*Primary Examiner* — Abigail Morrell
(74) *Attorney, Agent, or Firm* — Lowe Graham Jones PLLC

(57) ABSTRACT

A clasp system for attaching two elements, comprising first and second parts (A, B) each having a body (10, 11) for attachment to a respective one of the elements. The first and second parts having a fastening means comprising first and second fastening portions (1, 6), the first part including the first fastening portion and the second part including the second fastening portion. The first fastening portion and the second fastening portion are respectively configured for clipping engagement to fasten the first and second parts together. The unfastening comprises a relative twist movement of the first and second parts to unclip the first and second fastening portions. The first and second parts further comprise magnetic material (2, 3, 4, 5) arranged to pull the first and second parts together into the clipping engagement when the first and second parts are relatively oriented in a predetermined manner and spaced less than a predetermined maximum distance apart.

10 Claims, 6 Drawing Sheets

(56) References Cited

U.S. PATENT DOCUMENTS

| | | | | |
|---|---|---|---|---|
| 7,690,088 | B2 * | 4/2010 | Kogen | A44C 5/2042 24/303 |
| 2003/0229974 | A1 * | 12/2003 | Zemer | A44C 5/2076 24/303 |
| 2012/0050101 | A1 * | 3/2012 | Whiteman | G01S 5/0027 342/357.31 |
| 2013/0328683 | A1 * | 12/2013 | Sitbon | G08B 21/088 340/573.6 |

* cited by examiner

CLASP SYSTEM

FIELD OF THE INVENTION

The invention relates to a clasp system for attaching two elements.

BACKGROUND

It is common to wear a device around a wrist, the device, for example, being a watch, bracelet or wristband. Such a device typically includes a clasp. It may be difficult to fasten the clasp, especially for certain people.

People with poor dexterity may have difficulty fastening such a clasp. In particular, elderly people often have poor dexterity and so may have such difficulty. Some people also suffer a lack of feeling or numbness in their fingers, which can make fastening a clasp difficult. Such numbness is common in elderly people and this may exacerbate the difficulty caused by poor dexterity.

People suffering from certain mental conditions, such as dementia, may also have difficulty in remembering how to operate a clasp mechanism to fasten or undo the clasp.

People suffering from impaired eyesight may also have difficulty with certain known clasps; they may not be able to see small elements of the clasp.

Some existing attempts to address these problems have relied on making the clasp larger, since the elements are thus larger, easier to operate and easier to see. However, this disadvantageously results in larger, heavier and ugly clasps, which is particularly undesirable when the intended wearer of the device including the clasp may be a frail, elderly person.

Various clasps have been designed which include permanent magnets. For example, a known document, U.S. Pat. No. 2,648,884, discloses a magnetic clasp having two rigid, two-pole permanently magnetic parts with an interlocking tongue and groove connection to mechanically lock the two parts against relative sliding movement tending to separate the two parts.

Another known document, U.S. Pat. No. 4,941,236, discloses a strap for a wristwatch having a pair of separable flexible strap ends that can each overlap the other to provide an overlapped section. The strap ends nest against each other through mutually interlocking teeth, which prevents relative sliding movement of the two ends. The strap ends are also magnetised to impede unlocking of the teeth.

It is an object of the present invention to provide an improved clasp, which fastens together securely and can be undone easily.

SUMMARY OF THE INVENTION

In accordance with a first aspect of the present invention, there is provided a clasp system for attaching two elements, comprising first and second parts each having a body for attachment to a respective one of the elements, the first and second parts having a fastening means comprising first and second fastening portions, the first part including the first fastening portion and the second part including the second fastening portion, wherein the first fastening portion and the second fastening portion are respectively configured for clipping engagement to fasten the first and second parts together, wherein unfastening comprises a relative twist movement of the first and second parts in one direction to unclip the first and second fastening portions, wherein the first and second parts further comprise magnetic material arranged to pull the first and second parts together into the clipping engagement when the first and second parts are relatively oriented in a predetermined manner and spaced less than a predetermined maximum distance apart.

Advantageously, the magnetic material results in the clipping engagement without need for any user intervention. The magnetic material results in a snap fastening. The clasp system is simple to latch and unlatch, even by wearers who have impaired dexterity. The twist movement is advantageously unlikely to be inadvertently activated.

The clasp system is particularly well suited to use where an article incorporating the clasp system is to be worn snuggly, since the clasp system can easily be made of generally small and flat shape. Where the clasp system is incorporated in an article to be worn around a body part, such as around a wrist, ankle, waist or neck, tension in straps to which the clasp system is typically attached usefully discourages inadvertent unfastening. Conveniently, the clasp system preferably only has two parts as far as the user is concerned.

The first and second parts may include a further fastening means comprising first and second further fastening portions, the first part including the second further fastening portion and the second part including the first further fastening portion, wherein the first further fastening portion and the second further fastening portion are respectively configured for clipping engagement to fasten the first and second parts together, wherein the first and second fastening portions and the first and second further fastening portions are arranged for simultaneous clipping engagement, wherein the relative twist movement of the first and second parts unclips the first and second fastening portions and the first and second further fastening portions.

The magnetic material may also be arranged to pull the first and second parts together into the clipping engagement when the first and second parts are relatively oriented in the predetermined manner and spaced less than a predetermined distance apart.

Preferably, the first part comprises a pivot pin extending therefrom, the pivot pin having an axis; and the second part comprising a pivot pin recess therein, configured to receive the pivot pin, wherein the pivot pin and the pivot pin recess are respectively configured to permit angular movement of the pivot pin in the pivot pin recess about the axis, wherein the relative twist movement is about the axis of the pivot pin. The pivot pin aids engagement and removal of the first and second parts. Also, the pivot pin and pivot pin recess result the clasp system having improved lateral strength.

The pivot pin may be tapered to be narrower at an end thereof remote from the rest of the first part.

The magnetic material may also be arranged to pull the pivot pin into the pivot pin hole when the first and second parts are relatively oriented in said predetermined manner and spaced less than said predetermined maximum distance apart.

The pivot pin may be located between the first fastening portion and the second further fastening portion, and wherein the pivot pin recess is located between the second fastening portion and the first further fastening portion.

The pivot pin may be located substantially midway between the first fastening portion and the second further fastening portion, and the pivot pin recess is located substantially midway between the first further fastening portion and the second fastening portion, so that a twist action acts substantially equally on the fastening means and the further fastening means.

The unfastening the first and second parts may comprise the twist movement until each of the first fastening means and the first further fastening means have respectively exited the second fastening means and the second further fastening means.

The relative twist movement about the pivot pin axis for release of the first and second parts may be to a minimum angle about the pivot pin axis.

The first fastening portion and the first further fastening portion may each comprise a locking member extending from the respective body, the second fastening portion and the second further fastening portion may each comprise a locking recess in the respective body, and the locking member and the locking recess of each of the fastening means and the further fastening means may be configured for the clipping engagement when the locking member is located in the corresponding locking recess.

Each locking recess preferably includes an open side, wherein the relative twist movement causes the locking member to exit the corresponding locking recess through the open side thereof.

Each of the first and second parts may include a facing portion, wherein the first and second fastening portions and the pivot pin are at the facing portion of the first part, and the first and second further fastening portions and the pivot pin recess are at the facing portion of the second part, wherein, when the first and second parts are relatively oriented in the predetermined manner, the facing portions face and the corresponding parts are approximately aligned.

The magnetic material may comprise: a first magnetic element located in the body of the first part between the first fastening portion and the pivot pin; a second magnetic element located in the first part between the second further fastening portion and the pivot pin; a third magnetic element located in the second part between the second fastening portion and the pivot pin recess; and a fourth magnetic element located in the second part between the first fastening portion and the pivot pin recess; wherein the first magnetic element and the fourth magnetic element attract each other, the second magnetic element and the third magnetic element attract each other, the first magnetic element and the third magnetic element repel each other, and the second magnetic element and the fourth magnetic element repel each other. Consequently, it is not possible for the magnets to draw the first and second fastening portions and the first and second further fastening portions together if they are incorrectly relatively oriented, rendering correct use of the clasp system very simple.

When the first and second parts are fastened together, the first and second fastening means usefully prevents parting movement of the first and second parts in opposing directions along the axis of the pivot pin.

Each of the first and second parts includes an indicator portion on an outer surface thereof, said indicator portions indicating where on the first and second parts to apply finger pressure to initiate the relative twist movement of the first and second parts. The indicator portions may be in the form of an image, text, different texture to the surrounding texture, different colour to the surrounding colour, or a raised or lowered portion. Such indicator portions provide an intuitive direction for removal.

There may be provided a wrist or ankle band comprising: the clasp system of any one of the preceding claims, arranged to secure the wristband around a wrist of a wearer; a band portion have the two ends, one end attached to the first part of the clasp system and the other end attached to the second part; a device arranged to transmit location information indicative of the location of the wearer.

According to a second aspect of the present invention, there may be provided a method comprising: fastening the first and second parts together by relatively oriented the first and second parts in a predetermined manner and spacing the first and second parts less than a predetermined distance apart, wherein a first fastening portion of the first part and a second fastening portion of the second part are then drawn together into a clipping engagement by magnetic material in at least one of the first and second parts; unfastening the first and the second parts by a relative twist movement of the first and second parts in one direction, in which the first and second fastening portions unclip.

A first further fastening portion of the second part and a second further fastening portion of the first part may also be drawn together into a clipping engagement simultaneously with the first fastening portion and the second fastening portion by the magnetic material, wherein the first further fastening portion and the second further fastening portion unclip in the relative twist movement.

A pivot pin may be drawn into a pivot pin recess simultaneously with the first fastening portion and the second fastening portion, by the magnetic material, wherein the relative twist movement is about an axis of the pivot pin.

BRIEF DESCRIPTION OF THE FIGURES

For better understanding of the present invention, embodiments will now be described, by way of example only, with reference to the accompanying Figures in which.

DETAILED DESCRIPTION OF EMBODIMENTS

Figure 1:
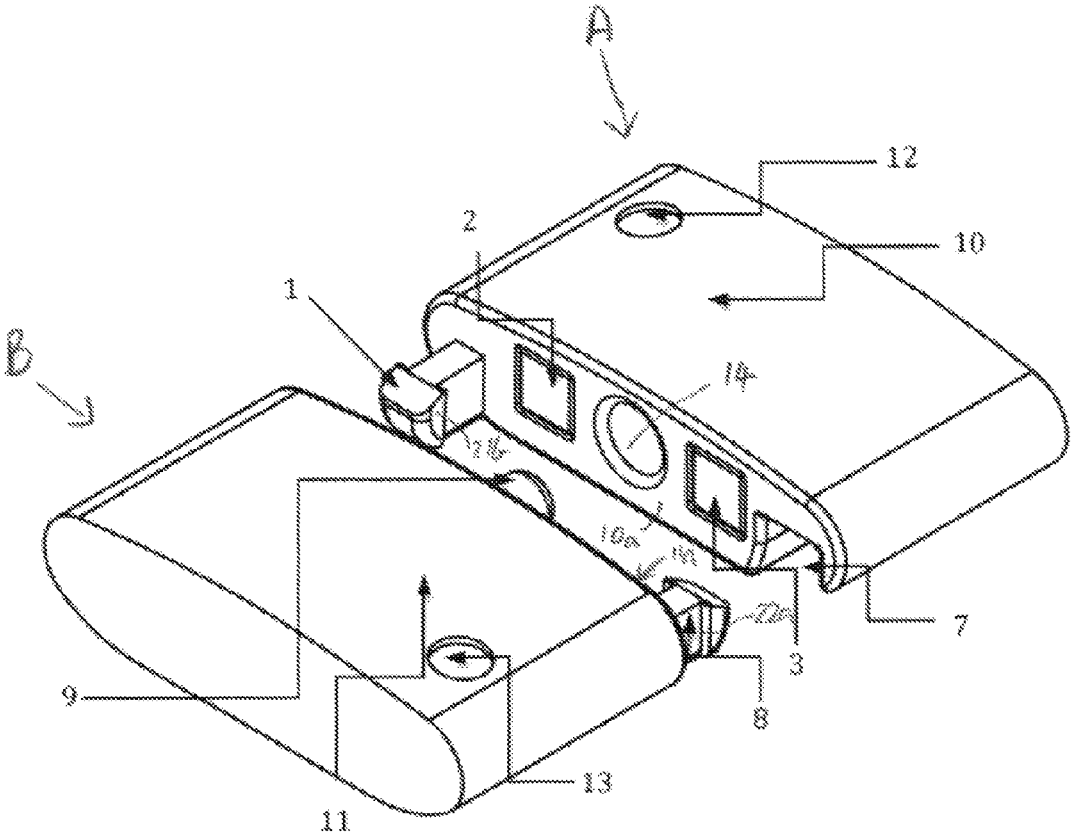
FIG. 1 is a perspective view of a clasp system in accordance with an embodiment of the invention, when first and second sub-assemblies A, B of the clasp system are separated.

Like reference numerals denote like parts throughout.

In an embodiment of the invention, a clasp system comprises two sub-assemblies A, B that are separable and can be attached together. The clasp system is intended for use to attach ends of a strap around a wrist, although use of the embodiment or other embodiments is not limited to such. For example, the clasp system can be used to attach ends of a strap other than around a wrist. Also, the clasp system can be used to attach elements other than ends of a strap.

Figure 2B:
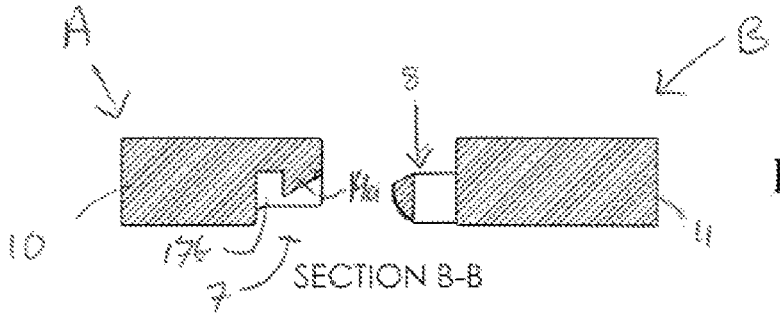
FIG. 2B is a sectional view through A-A in FIG. 2A.
Figure 2C:
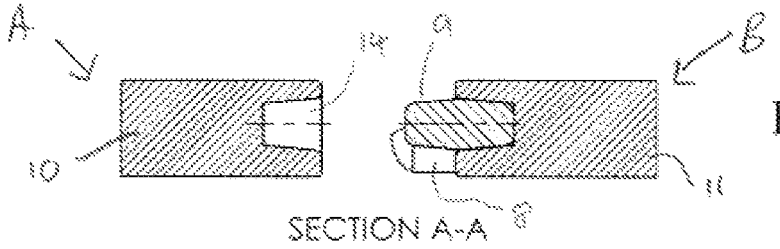
FIG. 2C is a sectional view through B-B in FIG. 2A.
Figure 2A:
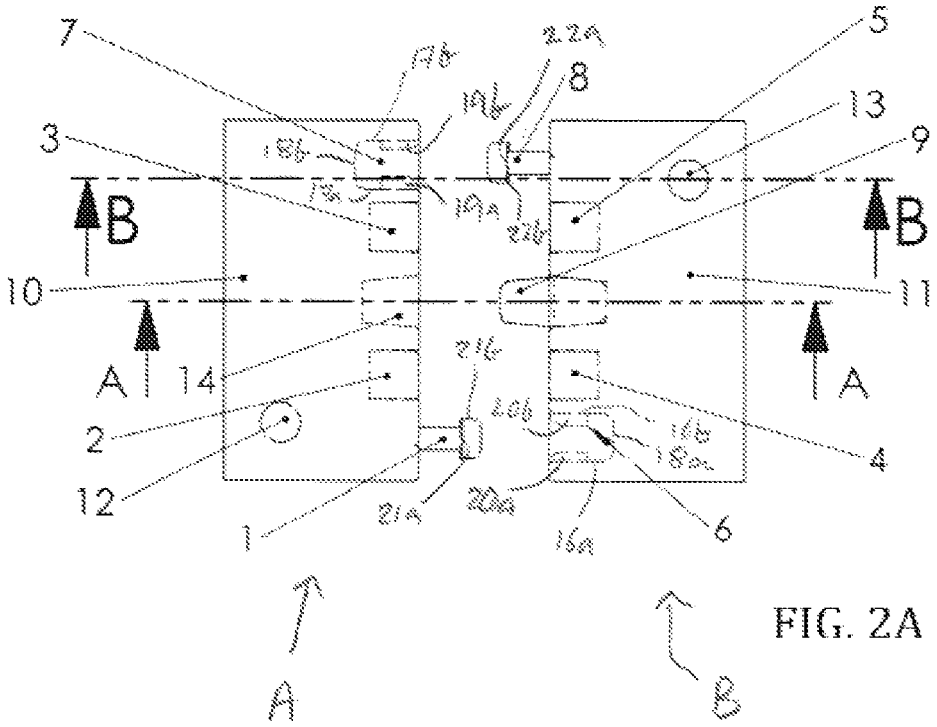
FIG. 2A is a plan view of the clasp system shown in FIG. 1, with internal parts being shown illustratively with dashed lines.
Figure 3A:
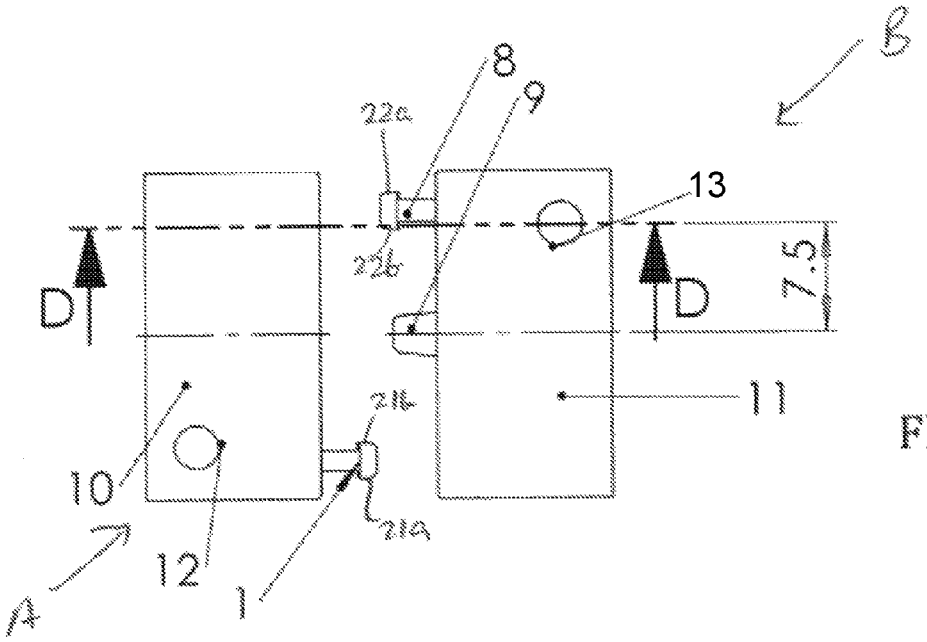
FIG. 3A is a plan view of the clasp system, when the two sub-assemblies A, B of the clasp system are separated and aligned for engagement.
Figure 3B:
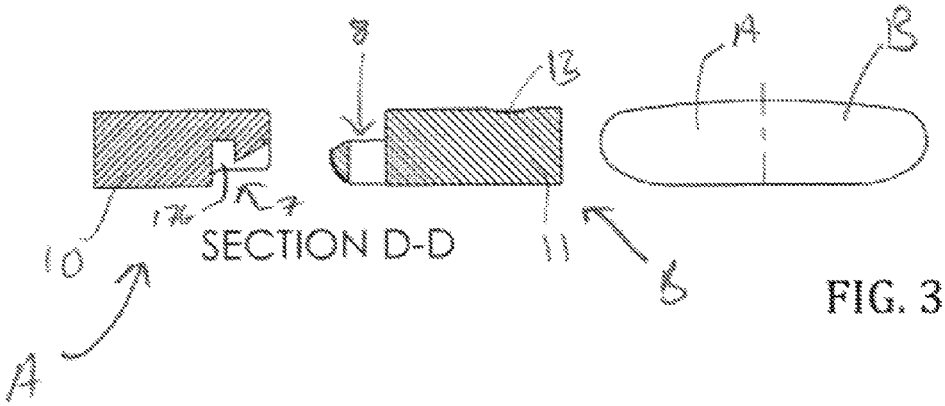
FIG. 3B is a sectional view through D-D in FIG. 3A, and also separately an illustrative diagram indicating the relative angles of the first and second sub-assemblies A, B in the view of FIG. 4A from an end perspective.

Referring to FIGS. 1 and 2A, the clasp system comprises first and second sub-assemblies indicated at A and B, which are can be engaged together and are separable. A first sub-assembly comprises a first main body 10 and first and second magnets 2, 3. The second sub-assembly comprises a second main body 11 and third and fourth magnets 4, 5. Although not shown, each of the first and second main bodies 10, 11 includes an entry hole to which an end of a strap can be attached. Preferably, the entry hole follows the contour of the strap, facilitating the clasp system being small. In this embodiment, the dimensions of the length and width of the clasp system when the first and second sub-assemblies are engaged together is about 20 mm by 20 mm. Such dimensions render the clasp mechanism suitable for location on a lower portion of a wearer's wrist, where a watch clasp may conventionally be located. Such dimensions are also large enough so that sufficient purchase can easily be had to undo the clasp system. Notably, should in another embodiment the clasp be intended to fasten straps around a person's waist, dimensions of 50 mm by 50 mm are possible and may be more appropriate.

The main bodies 10, 11 each have a respective elongate side face 10*a*, 11*a*. When the sub-assemblies A, B are engaged together, the side faces 10*a*, 10*b* are flush against each other. The second main body 11 has a pivot pin 9 of circular cross-section extending orthogonally from the side face 11*a* of the second main body 11. The first main body 10 has a pivot pin hole 14 of shape corresponding to the shape of the pivot pin 9 into which the pivot pin 9 extends when the first and second sub-assemblies A, B are engaged together. The pivot pin 9, together with other parts, prevents sliding movement of the main bodies 10, 11 along their side faces 10*a*, 11*a*, while also permitting relative twist movement of the two main bodies 10, 11 around the axis of the pivot pin. The pivot pin is about 6 mm long, although may be otherwise sized in variant embodiments.

The pivot pin 9 is tapered. The amount of draft is about 10 degrees. In variant embodiments, an amount of draft of between 1 and 10 degrees may be provided. The tapering facilitates entry of the pivot pin 9 into the pivot hole 14. The pivot hole 14 is also tapered to correspond to the shape of the pivot pin 9, for tight engagement of the pivot pin 9 in the pivot hole 14. Both the edges of an end of the pivot pin 9 and the pivot hole 14 are also bevelled to ease engagement. Preferably the radius of the bevelling is at least 1 mm.

The first and second main body 10, 11 also respectively include a first clip 1 and a second clip 8, and, respectively, first and second sockets 6, 7. The first clip 1 extends orthogonally from the side face 10*a* of the first main body 10 on a one side of the pivot hole 14, and the first socket 7 is located on the other side of the pivot hole 14. The second clip 8 extends orthogonally from the side face 11*a* of the second main body 11 on a one side of the pivot pin 9, located for engagement in the first socket 7. The second socket 6 is located on the other side of the pivot pin 9 to the second clip 8. The first and second clips 1, 8, the first and second sockets 6, 7 and the pivot pin 9 and the pivot hole 14 are respectively spaced so that (i) the pivot pin 9 and the pivot hole 14, (ii) the first clip 1 and the second socket 6, and (iii) the second clip 8 and the first socket 7, can be aligned and simultaneously engaged. The first and second clips 1, 8 require angular movement about the pivot axis to engage, and the capability of the pivot pin 9 to rotate in the pivot hole 14 allows this.

The first magnet 2 is located in a first recess in the first main body 10 between the first clip 1 and the pivot hole 14, The second magnet 3 is located in a second recess in the first main body 10 between the first socket 7 and the pivot hole 14. The third magnet 4 is located in a third recess in the second main body 11 between the second socket 6 and the pivot pin 9. The fourth magnet 5 is located in a fourth recess in the second main body 11 between the second clip 8 and the pivot pin 9. The first magnet 2 and the third magnet 4 have unlike poles and so are attractive to each other. The second magnet 3 and the fourth magnet 5 also have unlike poles and so are attractive to each other. The first and second magnets 2, 3 have unlike poles and the third and fourth magnets 4, 5 have unlike poles. Thus, the magnets are paired. Notably, the first magnet 2 does not attract the fourth magnet 5 and the second magnet 3 does not attract the third magnet 4. Accordingly, when the first and second side faces 10*a*, 11*a* are spaced a predetermined maximum distance apart, the first and second clips 1, 8 are drawn to engage in their respective sockets 6, 7 and the pivot pin 9 is drawn into the pivot hole 14. If the sub-assemblies A, B are not appropriately disposed, the magnets 2, 3, 4, 5 act to turn the first and second sub assemblies angularly with respect to each other, moving them towards the appropriate disposition for the clips, sockets, pivot and pivot hole to engage. When the elements are appropriately aligned, and are approximately 5 mm from each other, the force of the magnets is sufficient as to pull the two sub-assemblies towards each other. The distance at which this occurs depends on the strength of the magnets and may be greater or lesser in variant embodiments. The magnets 2, 3, 4, 5 are permanently secured in their respective hole through a tight interference fit. In variant embodiments, the magnets may be otherwise secured, for example by means of adhesive or use of thread arrangement.

Each of the first and second sockets 6, 7 has an open side, two opposing side walls 16*a*, 16*b*, 17*a*, 17*b* extending to define the open side, and a bridging wall bridging the two side walls. The two side walls and the bridging wall each extend to a bottom wall 18*a*, 18*b*. Each of the first and second sockets 6, 7 has a pair of engagement portion 19*a*, 19*b*, 20*a*, 20*b*, each engagement portion extending from a respective side wall and also the bridging wall. Each engaging portion provides a ramp surface, having a slope extending from an edge of the bridging wall, the edge being at the corresponding side face 10*a*, 11*a*, and sloping into the socket. Each engaging portion 19*a*, 19*b*, 20*a*, 20*b* also has an abutment surface extending from the bridging wall to the end of the ramp surface within the respective socket, and defines a space between the ramps surface and the bottom of the socket.

Each of the first and second clips 1, 8 has a head extending in a T-shape to provide a pair of ridges 21*a*, 21*b*, 22*a*, 22*b*. On each clip, one ridge projects generally away from the pivot pin axis and the other ridge projects generally towards the pivot pin axis. The ridges are sized to fit in the space between a corresponding abutment surface and the bottom of the corresponding socket. Each head is also bevelled to permit twist when in the corresponding socket.

Each main body 10, 11 also includes an opening indicator 12, 13 to assist a user of the clasp system in pressing the appropriate places on the sub-assemblies A, B to enable the user to release the sub-assemblies from each other. In the Figures, each opening indicator is in the form of a dot, although other forms of opening indicator may be alternatively provided.

Operation of the clasp system will now be described. In FIGS. 1, 2A to 2C, 3A and 3B, the first and second sub-assemblies A, B are in a spaced configuration and are relatively oriented so that the first and second clips 1, 9 are aligned with their respective socket 6, 7 and the pivot pin 9 is aligned with the pivot pin socket 14. When the spacing of the first and second sub-assemblies A, B is less than a predetermined maximum spacing, for example 5 mm, the precise maximum spacing depending on the strength of the magnetic elements 2-5, the first and second sub-assemblies A, B are drawn together. Usefully, the alignment of the first and second sub-assemblies A, B does not have to be precise. Since the pivot pin 9 is in the shape of a conical frustum, the first and second sub-assemblies A, B are drawn together smoothly even if the first and second sub-assemblies A, B are only in approximate alignment. Also, the arrangement of like and unlike poles of the magnetic elements causes self-adjustment of the alignment, facilitating entry of the clips 1, 8 into the sockets 6, 7 and the pivot pin 9 into the pivot pin socket 14.

Figure 4A:
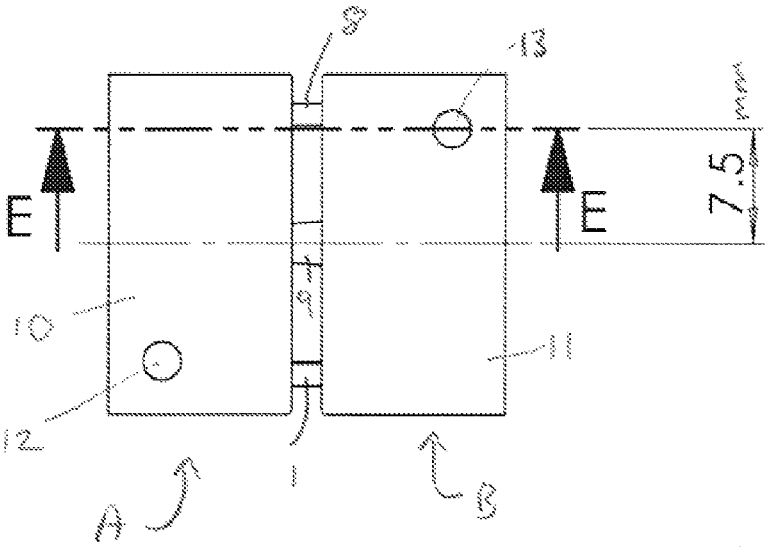
FIG. 4A is a plan view of the clasp system of the embodiment.
Figure 4B:
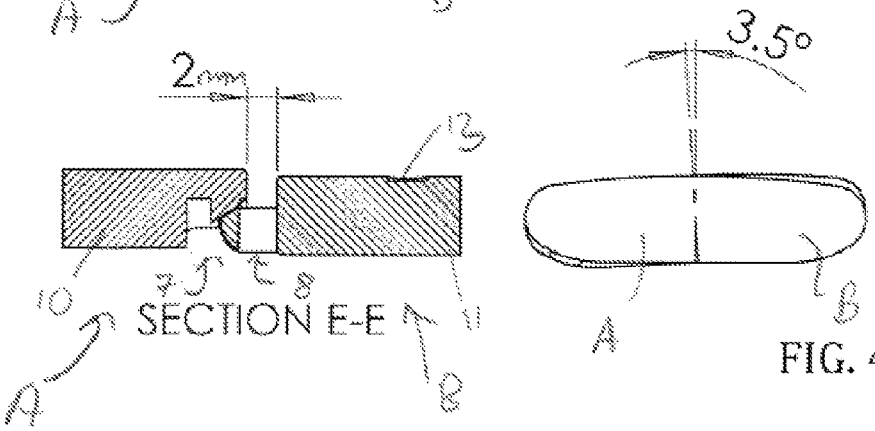
FIG. 4B is a sectional view of the clasp system through E-E in FIG. 4A, and also separately an illustrative diagram indicating the relative angles of the first and second sub-assemblies A, B in the view of FIG. 4A from an end perspective.
Figure 5:
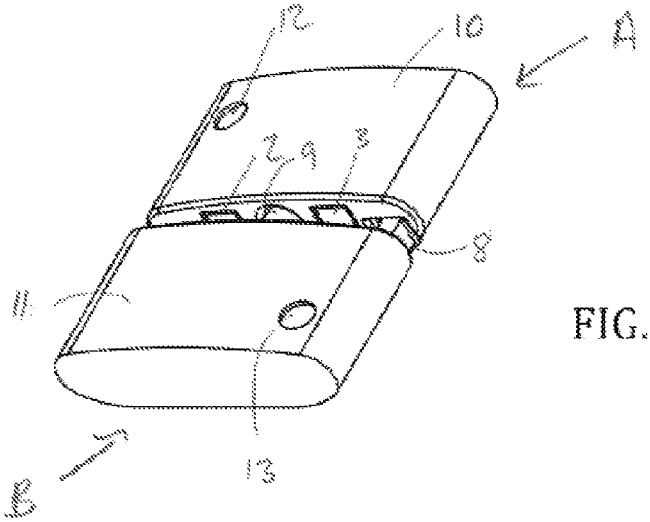
FIG. 5 is a perspective view of the clasp system shown in FIG. 4A when the first and second sub-assemblies A, B.
Figure 6A:
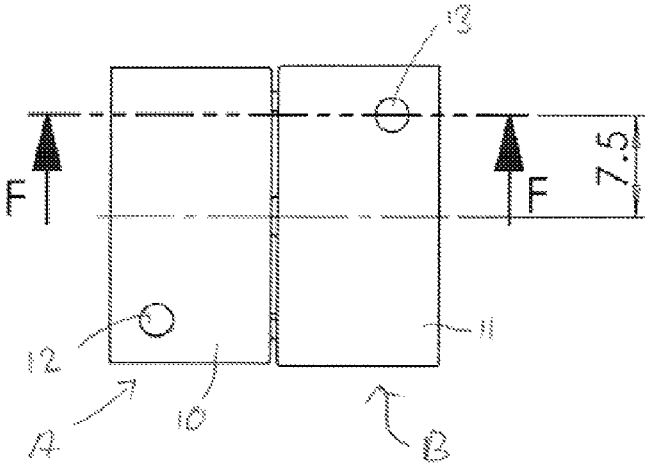
FIG. 6A is a plan view of the clasp system of the embodiment in further partial engagement.
Figure 6B:
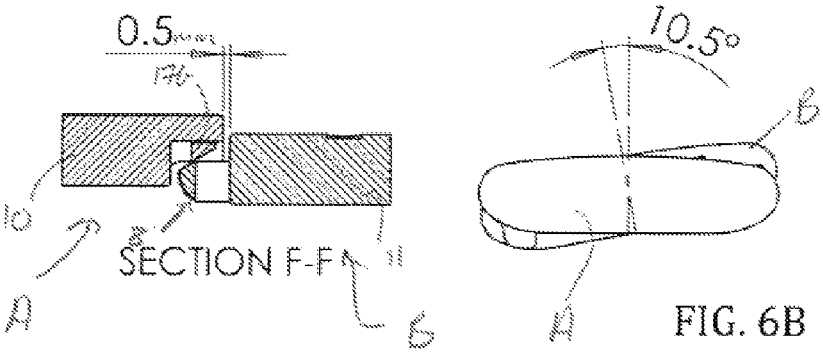
FIG. 6B is a sectional view of the clasp system, through F-F in FIG. 6A, and also separately an illustrative diagram indicating the relative angles of the first and second sub-assemblies A, B in the view of FIG. 6A from an end view.
Figure 7:
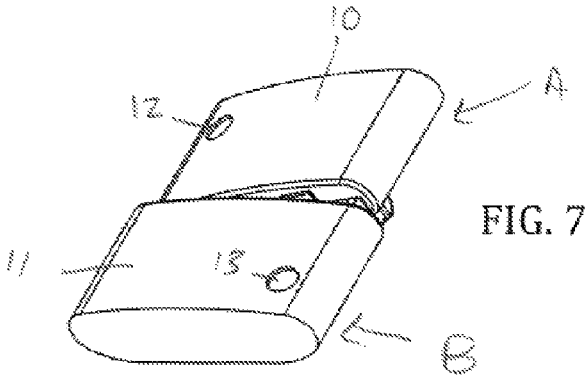
FIG. 7 is a perspective view of the clasp system shown in FIG. 6A when the first and second sub-assemblies A, B are in the state of further partial engagement.

The head of each of the first and second clips 1, 8 then abuts against a ramping surface of the corresponding engagement portion 19*a*, 19*b*, 20*a*, 20*b* as it enters the respective socket 6, 7. As the head moves along the ramp surface due to the action of the magnetic elements, each clip 1, 8 moves towards the open side of the socket 6, 7. This results in a relative twist movement of the first and second sub-assemblies A, B about the axis of the pivot pin 9. In FIGS. 4A, 4B and 5, the first and second sub-assemblies A, B are shown at a relative angle of about 3.5 degrees due to the twist movement. In FIGS. 6A, 6B and 7, the first and second sub-assemblies A, B are shown at a relative angle of about 10.5 degrees, which is the maximum twist angle that the action of the ramp surface on the heads causes. As can be seen in FIG. 1, the head includes chamfers, which permit angular movement of the head in the corresponding socket 6, 7. None of FIGS. 4A to 7 indicates a natural resting point of the clasping system. Rather, these figures provide snapshots of the fastening process.

After reaching 10.5 degrees, the head of each of the first and second clips 1, 8 passes the engagement portion twists under the action of the magnets 2-5 so that each ridge 21*a*, 21*b*, 22*a*, 22*b* engages in the space between the bottom of the socket and the abutment surface of the engagement portion 19*a*, 19*b*, 20*a*, 20*b*. Accordingly, once the first and second sub-assemblies A, B are aligned they engage in a snap-fit manner under the action of the magnets 2-5.

Figure 8A:
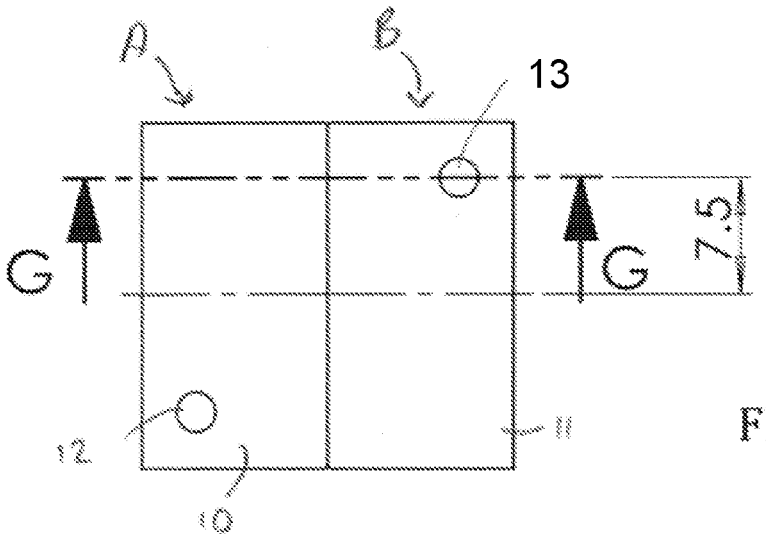
FIG. 8A is a plan view of the clasp system of the embodiment, when the first and second sub-assemblies A, B are attached together.
Figure 8B:
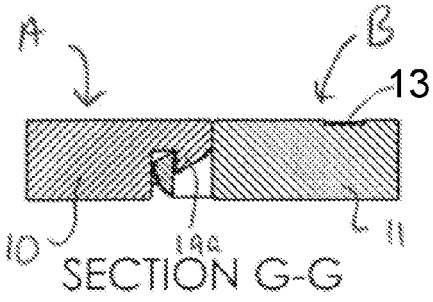
FIG. 8B is a sectional view of the clasp system, through G-G in FIG. 8A, and also separately an illustrative diagram indicating the relative angles of the first and second sub-assemblies A, B from an end perspective.
Figure 8B:
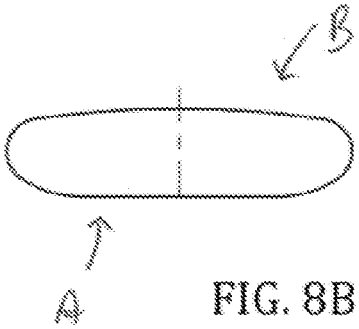
Figure 9:
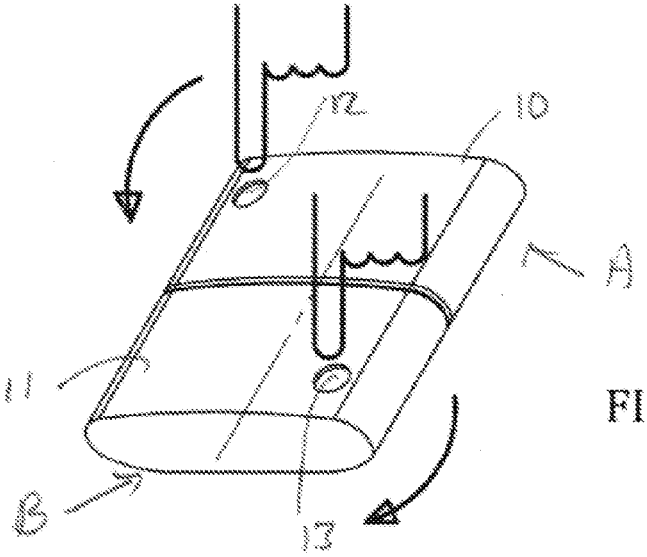
FIG. 9 is a perspective view of the clasp system shown in FIG. 8A when the first and second sub-assemblies A, B are fastened together.

In FIGS. 8A, 8B and 9, the first and second sub-assemblies A, B are engaged. As shown in FIG. 8B, upper and lower surfaces of the first and second main bodies 10, 11 are respectively aligned. When so engaged, all outer surfaces are smooth. The side faces 10*a*, 11*a* of the first and second main bodies are flush against each other.

To unfasten the clasp system to separate the first and second sub-assemblies A, B, finger pressure on approximately the marks 13, 14 causes an appropriate relative twisting movement. The twist action is in a single direction. In other words, pressing of the first and second sub-assemblies A, B towards wrist or other body part results in release. After the twisting movement results in the first and second sub-assemblies A, B twisting by at least 10.5 degrees about the pivot pin axis, the clips 1, 8 can be pulled from the sockets 6, 7 against the force exerted by the magnets.

The clasp system described above can be made small and simple, yet highly effective and easy to fasten and release. It does not include any moving parts, but relies on magnetism and mechanical engagement to provide a clasping force.

The main bodies 10, 11 may be produced in a moulding process. Apart from the magnetic elements, the parts may be formed of plastic in an injection moulding process. Alternatively, the parts may be cast from metal using a casting process or a metal injection moulding process. In the latter case, the magnets may be installed whilst the main bodies are still hot, such that the bodies will shrink over the magnets thereby to permanently secure them in place.

In a preferred embodiment, the second main body 11 is made without the pivot pin 9, but made instead with a hole identical to the pivot hole 14. The pivot pin 9 is made separately in the form of a symmetrical double ended cone or conical frustum, with a pivot hole in each main body 10 being shaped to receive half of the pivot pin, and affixed in the hole. The pivot pin 9 may be permanently fixed in the hole by a tight inference fit or by means of adhesive. This permits, initially, the second main body 11 to be made identical to the first main body 10, resulting in economies in the manufacturing process. Alternatively, the pivot pin 9 may be integrally formed with the second main body 11.

Where the pivot pin 9 is secured in the pivot pin recess and the magnetic elements 2-5 are secured by an interference fit, this may be aided by appropriate heating and cooling of the bodies of the first and second main bodies, advantageously including in a cooling part of the moulding process.

Although not shown, the clasp system is intended for use as part of a device for attaching to a wrist, in which the device includes a means for transmitting information indicative of location of the device. For example, the device may include a GPS (Global Positioning System) locator and a transmitter for transmitting GPS coordinates to a base station. Accordingly, the location of the wearer of the device can be tracked. The wearer is able to remove the device, but the device will not detach accidentally.

The clasp system is intended to join ends of a strap around a wrist, for example to enable attachment of a watch or other device. However, it will be appreciated that the clasp system has more general application as a fastener. The clasp system may be used where any device, article or ornamental item needs to be mounted or attached to the wrist or other parts of the body, such as to the ankle, neck or waist, or indeed other than on a person's body.

It will be appreciated by persons skilled in the art that various modifications are possible to the embodiments. For example, an angle of 10.5 degrees for release of the first and second sub-assemblies A, B is not essential. The angle is preferably between 25% and 50% of the height of the clasp assembly for a clasp for wrist mounting. Any less, and the clasp may be susceptible to accidental removal. If the angle required is greater than 50%, the clasp system may be difficult to remove when intended, since one or both of the first and second sub-assemblies A, B may have to be excessively pushed into a wearer's skin, resulting in discomfort.

The applicant hereby discloses in isolation each individual feature or step described herein and any combination of two or more such features, to the extent that such features or steps or combinations of features and/or steps are capable of being carried out based on the present specification as a whole in the light of the common general knowledge of a person skilled in the art, irrespective of whether such features or steps or combinations of features and/or steps solve any problems disclosed herein, and without limitation to the scope of the claims. The applicant indicates that aspects of the present invention may consist of any such individual feature or step or combination of features and/or steps. In view of the foregoing description it will be evident to a person skilled in the art that various modifications may be made within the scope of the invention.

The invention claimed is:

1. A clasp system for attaching two elements, comprising first and second parts each having a body for attachment to a respective one of the elements, the first and second parts having:

a fastening means comprising first and second fastening portions, the first part including the first fastening portion and the second part including the second fastening portion, wherein the first fastening portion and the second fastening portion are respectively configured for clipping engagement;

a further fastening means comprising first and second further fastening portions, the first part including the second further fastening portion and the second part including the first further fastening portion, wherein the first further fastening portion and the second further fastening portion are respectively configured for clipping engagement;

wherein the first part further comprises a pivot pin extending therefrom located between the first fastening portion and the second further fastening portion, the pivot pin having an axis;

wherein the second part comprises a pivot pin recess therein, located between the second fastening portion and the first further fastening portion, the pivot pin recess being configured to receive the pivot pin, wherein the pivot pin and the pivot pin recess are respectively configured to permit angular movement of the pivot pin in the pivot pin recess about the axis;

wherein the first and second fastening portions and the first and second further fastening portions are arranged so that the clipping engagement of the first and second fastening portions and the first and second further fastening portions is simultaneous and fastens the first part and the second part together;

wherein unfastening comprises a relative twist movement of the first and second parts about the axis of the pivot pin to unclip the first and second fastening portions and the first and second further fastening portions;

wherein the first and second parts further comprise magnetic material arranged to pull the first and second fastening portions and the first and second further fastening portions into the clipping engagement when the first and second parts are relatively oriented in a predetermined manner and spaced less than a predetermined maximum distance apart;

wherein the magnetic material comprises:

a first magnetic element located in the body of the first part between the first fastening portion and the pivot pin;

a second magnetic element located in the first part between the second further fastening portion and the pivot pin;

a third magnetic element located in the second part between the second fastening portion and the pivot pin recess; and a fourth magnetic element located in the second part between the first further fastening portion and the pivot pin recess; wherein the first magnetic element and the third magnetic element attract each other, the second magnetic element and the fourth magnetic element attract each other, the first magnetic element and the fourth magnetic element repel each other, and the second magnetic element and the third magnetic element repel each other.

2. The clasp system of claim 1, wherein the pivot pin is tapered to be narrower at an end thereof remote from the rest of the first part.

3. The clasp system of claim 1, wherein the magnetic material is also arranged to pull the pivot pin into the pivot pin recess when the first and second parts are relatively oriented in said predetermined manner and spaced less than said predetermined maximum distance apart.

4. The clasp system of claim 1, wherein the pivot pin is located substantially midway between the first fastening portion and the second further fastening portion, and the pivot pin recess is located substantially midway between the first further fastening portion and the second fastening portion, so that a twist action acts substantially equally on the fastening means and the further fastening means.

5. The clasp system of claim 1, wherein the unfastening of the first and second parts comprises the twist movement until each of the first fastening portion and the first further fastening portion have respectively exited the second fastening portion and the second further fastening portion.

6. The clasp system of claim 1, wherein the relative twist movement about the axis for release of the first and second parts is to a minimum angle about the axis.

7. The clasp system of claim 1, wherein:

the first fastening portion and the first further fastening portion each comprise a locking member extending from the respective body, the second fastening portion and the second further fastening portion each comprise a locking recess in the respective body, and the locking member and the locking recess of each of the fastening means and the further fastening means are configured for the clipping engagement when the locking member is located in the corresponding locking recess.

8. The clasp system of claim 1, wherein each of the first and second parts includes a facing portion, wherein the first fastening portion, the second further fastening portion, and the pivot pin are at the facing portion of the first part, and the first further fastening portion, the second fastening portion, and the pivot pin recess are at the facing portion of the second part, wherein, when the first and second parts are relatively oriented in the predetermined manner, the facing portions face and the corresponding parts are approximately aligned.

9. The clasp system of claim 1, wherein, when the first and second parts are fastened together, the fastening means and the further fastening means prevent parting movement of the first and second parts in opposing directions along the axis of the pivot pin.

10. The clasp system of claim 1, wherein each of the first and second parts includes a visible indicator portion on an outer surface thereof, said indicator portions indicating where on the first and second parts to apply finger pressure to initiate the relative twist movement of the first and second parts.

* * * * *